US008481117B2

(12) United States Patent
Ridgeway et al.

(10) Patent No.: US 8,481,117 B2
(45) Date of Patent: Jul. 9, 2013

(54) METHOD FOR APPLYING A THERMAL BARRIER COATING

(75) Inventors: Neil B. Ridgeway, South Windsor, CT (US); David A. Litton, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 276 days.

(21) Appl. No.: 12/719,594

(22) Filed: Mar. 8, 2010

(65) Prior Publication Data

US 2011/0217464 A1 Sep. 8, 2011

(51) Int. Cl.
*C23C 16/44* (2006.01)
*C23C 16/00* (2006.01)

(52) U.S. Cl.
USPC ..... 427/248.1; 118/724

(58) Field of Classification Search
None
See application file for complete search history.

(56) References Cited

U.S. PATENT DOCUMENTS

| | | | | |
|---|---|---|---|---|
| 4,676,994 | A | 6/1987 | Demaray | |
| 4,880,614 | A | 11/1989 | Strangman et al. | |
| 4,952,556 | A * | 8/1990 | Mantese et al. | 505/325 |
| 5,087,477 | A | 2/1992 | Giggins, Jr. et al. | |
| 5,243,169 | A * | 9/1993 | Tateno et al. | 219/121.51 |
| 5,716,720 | A | 2/1998 | Murphy | |
| 5,856,027 | A | 1/1999 | Murphy | |
| 6,301,434 | B1 * | 10/2001 | McDiarmid et al. | 392/416 |
| 6,478,888 | B1 | 11/2002 | Burns | |
| 6,730,422 | B2 | 5/2004 | Litton et al. | |
| 7,037,560 | B1 * | 5/2006 | Shinriki et al. | 427/553 |
| 7,226,672 | B2 | 6/2007 | Litton et al. | |
| 7,291,408 | B2 | 11/2007 | Litton et al. | |
| 7,326,470 | B2 | 2/2008 | Ulion et al. | |
| 7,422,771 | B2 | 9/2008 | Pietraszkiewicz et al. | |
| 7,455,913 | B2 | 11/2008 | Freling et al. | |
| 7,476,450 | B2 | 1/2009 | Maloney et al. | |
| 7,579,087 | B2 | 8/2009 | Maloney et al. | |
| 7,622,195 | B2 | 11/2009 | Schlichting et al. | |
| 7,662,489 | B2 | 2/2010 | Litton et al. | |

(Continued)

FOREIGN PATENT DOCUMENTS

| | | |
|---|---|---|
| EP | 1908857 | 4/2008 |
| JP | 2048404 | 2/1990 |

OTHER PUBLICATIONS

Awaji, JP2048404, Feb. 1990, English abstract of document from applicants IDS Jan. 21, 2013.*
Extended EP Search Report, Apr. 26, 2011.

*Primary Examiner* — Joseph Miller, Jr.
(74) *Attorney, Agent, or Firm* — O' Shea Getz P.C.

(57) ABSTRACT

A method and apparatus for forming thermally grown alpha alumina oxide scale on a substrate is provided. The method includes the steps of: a) providing a heating chamber having a heat source and an oxidizing gas source selectively operable to provide a stream of oxidizing gas; b) providing at least one substrate disposed in the heating chamber, which substrate has a composition sufficient to permit formation of an alpha alumina scale on one or more surfaces; c) maintaining a vacuum in the heating chamber at a level that inhibits formation of one or more low temperature oxides on the one or more surfaces of the substrate; d) heating at least one of the one or more surfaces of the substrate to a predetermined temperature at or above 1800 degrees Fahrenheit; and e) directing the stream of oxidizing gas at a controlled rate toward one or more heated surfaces of the substrate.

15 Claims, 4 Drawing Sheets

U.S. PATENT DOCUMENTS

| | | | | |
|---|---|---|---|---|
| 2002/0152961 | A1 | 10/2002 | Burns | |
| 2002/0185062 | A1* | 12/2002 | Halpin | 118/50.1 |
| 2003/0041928 | A1* | 3/2003 | Spitsberg et al. | 148/516 |
| 2003/0157363 | A1* | 8/2003 | Rigney et al. | 428/680 |
| 2003/0219605 | A1* | 11/2003 | Molian et al. | 428/422 |
| 2007/0125770 | A1* | 6/2007 | Hamaguchi | 219/651 |
| 2008/0292873 | A1* | 11/2008 | Nijdam et al. | 428/332 |
| 2010/0104766 | A1 | 4/2010 | Neal et al. | |

* cited by examiner

Figure 4. Growth Rate Vs Temperature of Thermally Grown Oxide (TGO) Developing on NiCoCrAlY Bond Coat

METHOD FOR APPLYING A THERMAL BARRIER COATING

BACKGROUND OF THE INVENTION

1. Technical Field

This disclosure relates to Electron Beam Physical Vapor Deposited Thermal Barrier Coatings (EB-PVD TBC) and methods for applying the same to a substrate in general, and to such coatings and methods that utilize a thermally grown oxide for ceramic to metallic adhesion in particular.

2. Background Information

Thermal barrier coating (TBC) systems have been developed to fulfill the demands placed on current high-temperature Ni-base superalloys for gas turbine applications in both aero engine and land based gas turbines. TBC systems typically consist of a ceramic (e.g., yttria-stabilized zirconia) top layer that has low thermal conductivity, is chemically inert in combustion atmospheres, and that is reasonably compatible with Ni-base superalloys. The ceramic top layer is often applied by a deposition process such as Electron Beam Physical Vapor Deposition (EB-PVD). To ensure adequate bonding between the ceramic topcoat and the metallic substrate, it is common (but not required) to use a bond coat (e.g., NiCoCrAlY) disposed between the ceramic top coat and the metallic substrate. Ceramic adhesion to the bond coat depends on the formation of a thin, slow-growing oxide layer (also designated as TGO: thermally grown oxide) developing on the bond coat.

TGOs grown from a NiCoCrAlY or similar bond coat in a vacuum (at about $10^0$ to $10^{-6}$ Torr) at temperatures less than 1800° F. will include certain oxides (e.g., eta phase alumina, and transition oxides, also referred to herein as "low temperature oxides") that assume a voluminous, low integrity form that tend to have lower adhesion to the bond coat than other oxides. TBCs attached to these oxides will, therefore, be subject to these weaker bonds, and may be the basis for spallation.

SUMMARY OF THE DISCLOSURE

According to one aspect of the invention, a method for forming thermally grown alpha alumina oxide scale on a substrate is provided. The method includes the steps of: a) providing a heating chamber having a heat source and an oxidizing gas source selectively operable to provide a stream of oxidizing gas; b) providing at least one substrate (e.g., airfoil, turbine blade, stator vane, etc.) disposed in the heating chamber, which substrate has a composition sufficient to permit formation of an alpha alumina scale on one or more surfaces; c) maintaining a vacuum in the heating chamber at a level that inhibits formation of one or more low temperature oxides on the one or more surfaces of the substrate; d) heating at least one of the one or more surfaces of the substrate to a predetermined temperature at or above 1800 degrees Fahrenheit; and e) directing the stream of oxidizing gas at a controlled rate to the one or more heated surfaces of the substrate.

According to another aspect of the invention, a method for conditioning a surface of a substrate prior to coating the surface is provided. The method includes the steps of: a) providing a coating chamber and a heating chamber, which heating chamber has a heat source; b) treating one or more surfaces of a substrate within the heating chamber by establishing a vacuum in the heating chamber, heating a surface of the substrate to a predetermined temperature, and directing a stream of oxidizing gas to the heated one or more surfaces of the substrate to form an oxide layer thereon; and c) coating the treated surface of the substrate in the coating chamber.

According to still another aspect of the invention, a system for forming a thermally grown oxide on a surface of at least one substrate is provided. The system includes a heating chamber, a vacuum pump, a heat source, and an oxidizing gas inlet. The heating chamber has a target location for locating the substrate. The vacuum pump is connected to the heating chamber and is selectively operable to establish a vacuum within the heating chamber. The heat source is disposed within the heating chamber, and is operable to radiate heat energy to the target location. The oxidizing gas inlet is disposed within the heating chamber, and is positioned to direct oxidizing gas to the target location for forming an oxide layer on the surface of the substrate.

The foregoing features of the invention will become more apparent in light of the following description and the accompanying drawings.

DETAILED DESCRIPTION OF THE INVENTION

Figure 1:
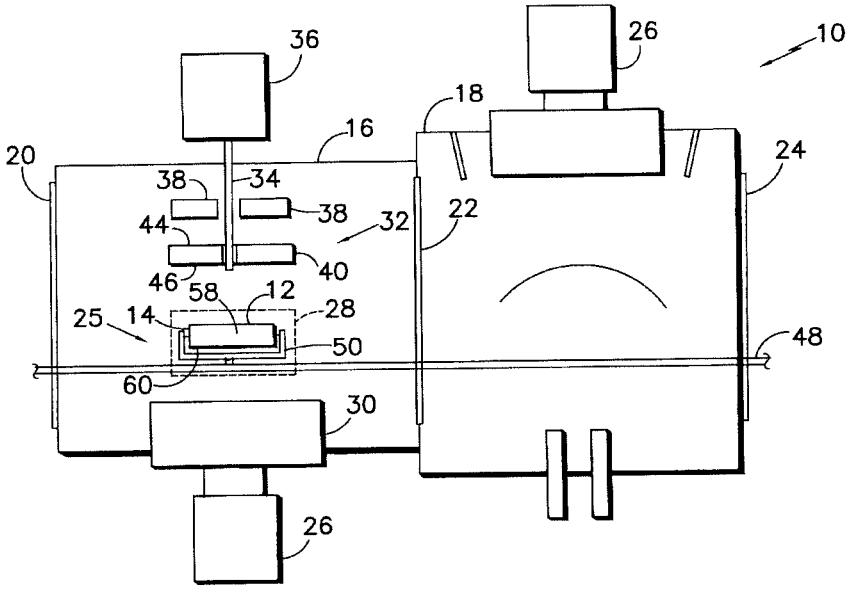
FIG. 1 is a side sectional diagrammatic illustration of one embodiment of a coating system for heating and coating a surface of at least one substrate.

Now referring to FIG. 1, a coating system 10 adapted to treat and coat a surface of at least one substrate 14 (e.g., a turbine blade airfoil for a gas turbine engine) is shown. The coating system 10 includes a plurality of successive vacuum chambers (e.g., a pre-heat chamber 16, a coating chamber 18) connected together via one or more gate valves 20, 22, 24. The coating system 10 further includes a transportation system 25 that directs the substrate 14 through the vacuum chambers 16, 18. The vacuum chambers 16, 18 are connected to at least one vacuum pump 26 (e.g., a diffusion pump). In some embodiments, the coating system 10 may include additional vacuum chambers such as, but not limited to, a load-lock chamber, or a post-treatment chamber, or any combination thereof.

The preheating chamber 16 is adapted to maintain a vacuum at or below approximately $10^{-3}$ Torr (e.g., between approximately $10^{-3}$ to $10^{-8}$ Torr). Alternatively, the preheating chamber 16 can be adapted to maintain the vacuum at or below approximately $10^{-4}$ Torr (e.g., between approximately $10^{-4}$ to $10^{-6}$ Torr). The requisite vacuum may vary slightly depending upon the application at hand, thereby necessitating a preheating chamber adapted accordingly. The preheating chamber 16 has a target location 28 for locating the substrate 14 during a treatment/pre-treatment process, and houses a vacuum pump inlet 30 (hereinafter "vacuum inlet"), a radiant heat source 32 (hereinafter "heat source"), and at least one oxidizing gas inlet 34 (hereinafter "gas inlet"). The vacuum inlet 30 connects the diffusion pump to the preheating chamber 16. The heat source 32 is adapted to heat the surface 12 of the substrate 14. Surface 12 of the substrate 14 is aligned to receive the radiant heating from the heating source. The gas inlet 34 connects an oxidizing gas source 36 (hereinafter "gas source") to the preheating chamber 16.

Figure 2:
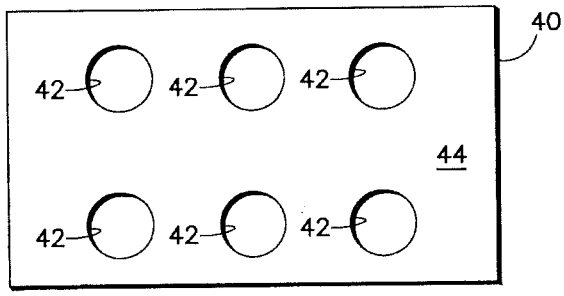
FIG. 2 is a top view diagrammatic illustration of one embodiment of an acceptor that is included in a heating chamber of the coating system in FIG. 1.

In the specific embodiment illustrated in FIG. 1, the heat source 32 includes one or more heating elements 38 and an acceptor plate 40 (hereinafter "acceptor"). The heating elements 38 and the acceptor 40 are aligned such that thermal heat energy (hereinafter "heat energy") radiates from the heating elements 38 to the surface 12 of the substrate 14 through the acceptor 40. Now referring to FIGS. 1-2, the acceptor 40 includes one or more flow apertures 42 that extend between first and second acceptor surfaces 44, 46 (e.g., top and bottom surfaces). Referring again to FIG. 1, each flow aperture 42 is configured to receive and orientate a respective one of the gas inlets 34 such that oxidizing gas injected therefrom is directed to the surface 12 of the substrate 14. The present invention, however, is not limited to the aforesaid embodiment. For example, in an alternate embodiment, the heat source 32 can include a plurality of acceptors, where adjacent acceptors are spaced to receive and orientate at least one of the gas inlets. The acceptor 40 can be constructed from any suitable material such as, but not limited to, graphite or graphite composite.

The coating chamber 18 is configured to deposit, for example, a ceramic (e.g., a TBC) coating on the surface of the substrate 14 by an EB-PVD process. EB-PVD coating chambers are well known in the art, and the present invention is not limited to any particular configuration thereof. Some examples of suitable EB-PVD coating chambers and processes are disclosed in U.S. Pat. No. 5,087,477 to Giggins, Jr. et al., and U.S. Publication No. 2008/0160171 (application Ser. No. 11/647,960) to Barabash et al., which are hereby incorporated by reference in their entirety.

In the embodiment in FIG. 1, the transportation system 25 includes a sting shaft 48 operable to move a sting 50 (i.e., a substrate carriage device), and thus the substrate 14, through the vacuum chambers 16, 18. The sting 50 can be adapted to adjust/manipulate the spatial position (e.g., height, etc.) and/or orientation (e.g., pitch, roll, etc.) of the substrate 14 in the vacuum chambers 16, 18. Such substrate transportation systems are well known in the art, and the present invention is not limited to any particular configuration thereof. For example, in alternate embodiments, the transportation system 25 includes a conveyor and a robotic manipulator disposed in each vacuum chamber 16, 18.

Figure 3:
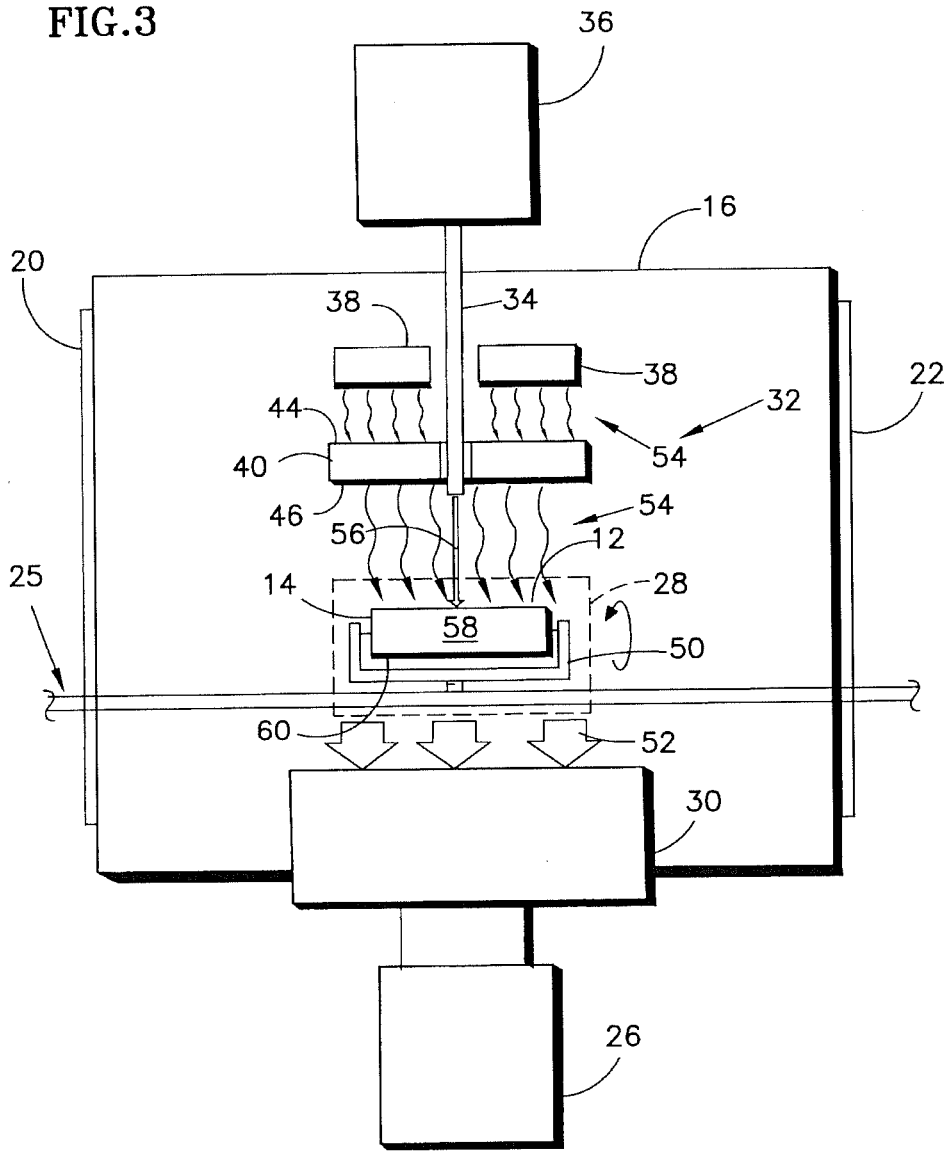
FIG. 3 diagrammatically illustrates a process for treating the surface of the substrate in the heating chamber.

Referring to FIG. 3, during operation, a vacuum, is established and maintained in the preheating chamber 16 via the vacuum inlet 30 and the diffusion pump 26. The vacuum is at or below approximately $10^{-3}$ Torr (e.g., between approximately $10^{-3}$ to $10^{-8}$ Torr) in some embodiments, and at or below approximately $10^{-4}$ Torr (e.g., between approximately $10^{-4}$ to $10^{-6}$ Torr) in other embodiments. The substrate 14 is directed, through a first gate valve 20, into the preheating chamber 16, and is positioned in the target location 28 via the sting 50 such that the surface 12 of the substrate 14 that is to be treated is aligned with (i.e., faces) the heat source 32 (e.g., the heating elements 38 and the acceptor 40). Under vacuum, gas 52 (e.g., oxidizing gases like oxygen or carbon dioxide) flows from a top region of the preheating chamber 16, for example proximate the heat source 32, creating a partial pressure adjacent surface 12; i.e., on the heated side of substrate 14.

Figure 4:
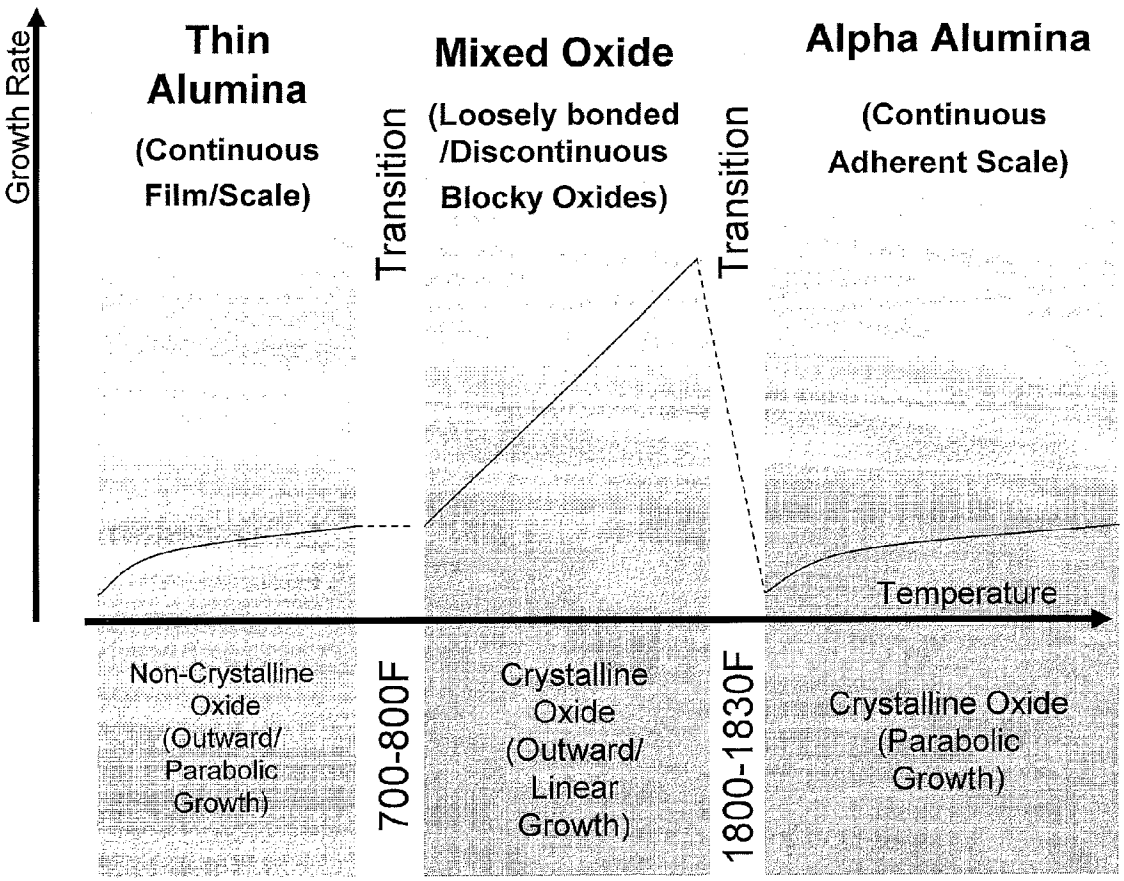
FIG. 4 graphically illustrates formation growth rates of alumina scales on the surface of a substrate versus the surface temperature of the substrate.

The heat source 32 heats the surface 12 of the substrate 14 via thermal radiation to a temperature above approximately 1800° F. For most applications, an acceptable substrate surface temperature range is about 1800° F. to about 1950° F., and substrate surface temperatures above 1830° F. work particularly well. For example, in the embodiment in FIGS. 1 and 3, the heating elements 38 radiate heat energy 54 to the top surface 44 of the acceptor 40. In the acceptor 40, the heat energy 54 disperses therethrough and radiates, in a substantially even/uniform pattern, from its bottom surface 46 to the surface 12 of the substrate 14. Referring to FIG. 4, as the surface temperature of the substrate 14 rises rapidly to approximately 1800° F., the surface 12 of the substrate 14 oxidizes, forming various oxides thereon such as theta phase alumina, nickel oxide, cobalt oxide, chromium oxide, etc. Low temperature (<1800° F.) phases of alumina and metallic oxides like nickel oxide, cobalt oxide and chromium oxide are loosely adherent and create a low integrity link between the metallic and ceramic as compared to thermally grown alpha alumina scale. With sufficiently high vacuum and a very small amount of time during ramp up between 700 and 1800° F., the formation of theta phase alumina, and other metallic oxides like nickel oxide, cobalt oxide, chrome oxide, etc. will be relatively minor When the temperature of the surface 12 of substrate 14 rises above approximately 1800° F. (e.g., to or above approximately 1830° F.), the oxidization reaction primarily forms a layer of alpha alumina on the surface 12 of the substrate 14 (e.g., on the NiCoCrAlY bond coat). In addition, at least a portion of the previously formed theta phase alumina will be transformed into alpha alumina.

Thus, for favorable adhesion of TBC ceramic on a bond coat (or on a substrate or other coating), a cohesive alpha alumina scale or layer (i.e., serves as a "metallic-ceramic bond") is desirable. Other thermally grown oxides can adversely affect TBC ceramic adhesion. The surface temperature of the substrate 14 should be rapidly heated above 1800° F. (e.g., to or above approximately 1830° F.) to reduce the quantity of the undesirable theta phase alumina, and other undesirable metallic oxides, that may form on the surface 12 of the bond coated substrate 14 at temperatures below 1800° F.

Referring again to FIG. 3, when the surface temperature of the substrate 14 has risen to or above approximately 1800° F. (e.g., to or above approximately 1830° F.), the gas source 36 injects, via each gas inlet 34, a stream of oxidizing gas 56 into the preheating chamber 16 for impingement against the heated surface 12 of the substrate 14 creating conditions promoting alpha alumina formation. For example, in the embodiment in FIGS. 1 and 3, the oxidizing gas 56 is directed from the gas inlet 34 to the heated surface 12 of the substrate 14. A controlled flow of oxidizing gas 56 provides oxygen (i.e., reactants) that directly influences the formation rate of alpha alumina on the heated surface 12 of the substrate 14. The flow of oxidizing gas is provided only after the surface 12 temperature of the substrate 14 has increased above 1800° F. (e.g., to 1830° F.). As a result, the conditions promote the formation of desirable alpha alumina and decrease the potential for the formation of undesirable oxides like theta phase alumina on the surface 12 of the substrate 14.

To form the alpha alumina layer on a large, compound, and/or irregular surface, the substrate 14 can be re-orientated (e.g., rotated, shifted, etc.) such that each portion of the surface is successively aligned with (e.g., directly below) the heat source 32 For example, referring to FIGS. 1 and 3, side and bottom surfaces 58, 60 of the substrate 14 can be treated (i.e., heated) by rotating the substrate 14 about, for example, its longitudinal axis such that each respective surface 12, 58, 60 is aligned with and treated by the heat source 32. In some embodiments, the rotational speed is controlled/regulated, via the sting 50, such that a substantial portion of the surface of the substrate 14 that is aligned with the heat source 32 is maintained at or above approximately 1800° F. (e.g., at or above approximately 1830° F.).

Figure 5:
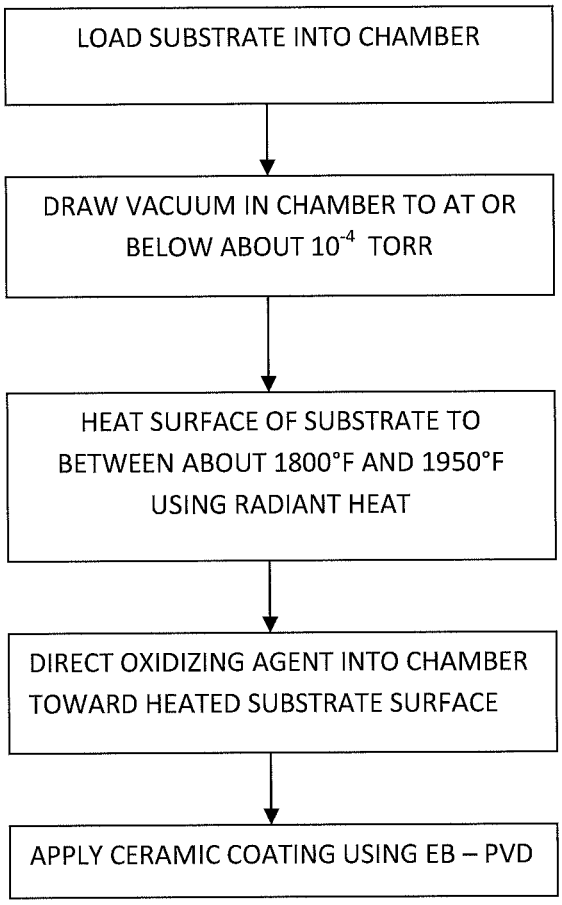
FIG. 5 is a flow chart illustrating an aspect of the present method.

After the TGO is developed on the coating required surface of substrate 14 treated in the preheating chamber 16, the substrate 14 is directed, via the sting 50, from the preheating chamber 16 to the coating chamber 18 through a respective second gate valve 22. In the coating chamber 18, the surface 12 of the substrate 14 is coated with, for example, a ceramic (e.g., TBC, etc.). The coating can be applied using any suitable deposition process such as, but not limited to, electron beam physical vapor deposition. When the surface of the substrate 14 has been coated, the substrate 14 is directed, through a respective third gate valve 24, out of the coating chamber 18 and the coating system 10. The flow chart shown in FIG. 5 summarizes the present process.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A method for forming thermally grown alpha alumina scale on a substrate, comprising:

providing a heating chamber having a heat source and an oxidizing gas source that is selectively operable to provide a stream of oxidizing gas, wherein the heat source includes a heating element and an acceptor plate comprising graphite;

providing at least one substrate disposed in the heating chamber, which substrate has a composition sufficient to permit formation of an alpha alumina scale on one or more surfaces;

maintaining a vacuum in the heating chamber at a level that inhibits formation of one or more low temperature oxides on the one or more surfaces of the substrate;

heating at least one of the one or more surfaces of the substrate, to a predetermined temperature at or above 1800 degrees Fahrenheit, by radiating heat energy from the heating element, through the acceptor plate, to the one or more surfaces of the substrate; and directing the stream of oxidizing gas at a controlled rate through the acceptor plate toward one or more heated surfaces of the substrate.

2. The method of claim 1, wherein the vacuum is established at or below approximately $10^{-3}$ Torr.

3. The method of claim 1, further comprising injecting the stream of oxidizing gas directly toward the substrate.

4. The method of claim 1, wherein the oxidizing gas source is selectively operable to provide the stream of oxidizing gas through a gas inlet;

the acceptor plate includes a flow aperture that extends therethrough and receives the gas inlet; and the stream of oxidizing gas is directed from the gas inlet toward the one or more heated surfaces of the substrate.

5. The method of claim 4, wherein the gas inlet extends through the flow aperture.

6. The method of claim 4, wherein a vacuum pump maintains the vacuum in the heating chamber through a vacuum pump inlet, and the substrate is disposed between the gas inlet and the vacuum pump inlet.

7. The method of claim 1, wherein the heat energy radiated by the heating element is dispersed in the acceptor plate, and the acceptor plate substantially uniformly radiates the dispersed heat energy to the one or more surfaces of the substrate.

8. The method of claim 1, further comprising reorientating the at least one substrate to heat another one of the surfaces of the substrate, and direct the stream of oxidizing gas toward the heated other one of the surfaces.

9. A method for conditioning a surface of a substrate prior to coating the surface, comprising:

providing a coating chamber and a heating chamber, which heating chamber has a heat source that includes a heating element and an acceptor plate comprising graphite;

treating one or more surfaces of a substrate within the heating chamber by:

establishing a vacuum in the heating chamber;

heating a surface of the substrate to a predetermined temperature by radiating heat energy from the heating element, through the acceptor plate, to the surface of the substrate; and directing a stream of oxidizing gas, through a gas inlet disposed with the acceptor plate, toward the heated surface of the substrate to form an oxide layer thereon; and coating the treated surface of the substrate in the coating chamber.

10. The method of claim 9, wherein the vacuum is established at or below approximately $10^{-3}$ Torr.

11. The method of claim , wherein the one or more surfaces of the substrate are heated to a temperature greater than or equal to approximately 1800 degrees Fahrenheit.

12. The method of claim 9, wherein the gas inlet extends through a flow aperture in the acceptor plate.

13. The method of claim 9, wherein a vacuum pump establishes the vacuum in the heating chamber through a vacuum pump inlet, and the substrate is disposed between the gas inlet and the vacuum pump inlet.

14. The method of claim 9, wherein the heat energy is dispersed in the acceptor plate, and the acceptor plate substantially uniformly radiates the dispersed heat energy to the surface of the substrate.

15. The method of claim 9, further comprising reorientating the substrate to heat another one of the surfaces of the substrate, and direct the stream of oxidizing gas toward the heated other one of the surfaces.

* * * * *